US011891801B2

(12) United States Patent
Makwich et al.

(10) Patent No.: US 11,891,801 B2
(45) Date of Patent: Feb. 6, 2024

(54) STRUCTURAL MEMBERS FOR WINDOWS

(71) Applicant: GRANDVIEW EA BUILDING SYSTEMS CORP., Vancouver (CA)

(72) Inventors: Gordon Donald Makwich, Vancouver (CA); Joel R. Schwartz, Burnaby (CA); Adam Jarolim, Burnaby (CA)

( * ) Notice: Subject to any disclaimer, the term of this patent is extended or adjusted under 35 U.S.C. 154(b) by 200 days.

(21) Appl. No.: 17/229,270

(22) Filed: Apr. 13, 2021

(65) Prior Publication Data

US 2022/0325520 A1 Oct. 13, 2022

(51) Int. Cl.
*E04B 2/96* (2006.01)

(52) U.S. Cl.
CPC ..... *E04B 2/967* (2013.01)

(58) Field of Classification Search
None
See application file for complete search history.

(56) References Cited

U.S. PATENT DOCUMENTS 3,978,629 A * 9/1976 Echols, Sr. ..... E04B 2/967 52/656.1
4,686,805 A * 8/1987 Forslin ..... E04B 1/0046 52/204.593
4,688,366 A * 8/1987 Schmidt ..... E06B 3/2675 52/204.593
5,038,537 A * 8/1991 Frambach ..... E06B 3/325 52/204.593
5,381,637 A * 1/1995 Farag ..... E06B 3/5427 52/204.593
7,533,501 B2 * 5/2009 Neal ..... E06B 1/36 52/208
9,212,482 B2 12/2015 Frederick
10,202,797 B1 * 2/2019 Header ..... E06B 3/26303
2014/0298740 A1 * 10/2014 Ting ..... E04B 2/90 52/302.1
2014/0345215 A1 * 11/2014 Magoon ..... E04B 2/965 52/235
2016/0237682 A1 * 8/2016 Stronks ..... E04B 2/965
2019/0078380 A1 * 3/2019 McKenna ..... E04B 2/96
2019/0085618 A1 * 3/2019 Al Kassas ..... E04B 2/90
2019/0194939 A1 * 6/2019 Frederick ..... E04B 2/967
2020/0102783 A1 * 4/2020 Ortuzar ..... B29C 48/12
2021/0131099 A1 * 5/2021 Kossman ..... E04C 3/11
2021/0355679 A1 * 11/2021 Newbrough ..... E04B 2/92
2022/0145623 A1 * 5/2022 Claeys ..... E04B 2/967

FOREIGN PATENT DOCUMENTS

CA 3096735 A1 12/2019
KR 10-2011-013982 12/2011

OTHER PUBLICATIONS

Insulbar North American Standard Program, Ensinger, 2020, Genloch NJ.

* cited by examiner

*Primary Examiner* — Joshua K Ihezie

(57) ABSTRACT

A structural member for a window comprising two extrusions spaced apart and coupled to each other using an insulating coupler extending at least 40 mm apart to form the structural member and hinder thermal bridging. A stiffener extends inside the structural member between the extrusions to stiffen the structural member and comprises two spaced apart ends engaged with the two extrusions, respectively. The two ends are coupled to each other using an insulating stiffener coupler to support the stiffener and hinder thermal bridging. A method of forming a thermally broken structural member.

16 Claims, 7 Drawing Sheets

STRUCTURAL MEMBERS FOR WINDOWS

TECHNICAL FIELD

The disclosure relates generally to window systems, and, more particularly, to metal (e.g. aluminium) window assemblies used in large office and residential buildings.

BACKGROUND

Heat may be transferred out of buildings by conduction, and radiation. Walls and window glass are major sources of conduction and radiative heat loss. Heat through windows may be lost through the glass and/or through structural supports of the windows.

Heat loss through walls may is reduced by using insulating materials such as rockwool or by using vacuum-insulated panels. Heat loss through windows may be achieved by increasing glass thickness, adding extra window glass in the form of triple glazing or more, and/or establishing a vacuum in glazed window cavities. Improving efficiency further may incur substantial costs.

Heat loss through structural supports of the windows may be countered by thermal breaking structures. In a pour-and-debridge process, a channel is formed in a structure (e.g. a groove), molten polyurethane is filled into the channel, and, after setting of the polyurethane, a bottom portion of the channel is cut away to separate two halves of the structure and form a thermal break. The width of such channels is typically between 6-10 mm to structurally preserve the polyurethane under live and seismic loading, and to reduce material costs associated with filling the channel with polyurethane. Polyurethane may nevertheless fail. Such an approach may be difficult, expensive, and cause unexpected failure if not carried out correctly (e.g. improper cutting may compromise the structure). Other types of thermal breaks are known. These may compromise structural performance and introduce flexibility into the structure. Flexibility in structures introduced due to thermal breaks may lead to catastrophic failures in window systems.

Improvement is desired.

SUMMARY

Increasing thermal efficiency of buildings is important for reducing greenhouse gas (GHG) emissions to address climate change and may help consumers offset costs arising from regulation and taxation of GHG emissions. In cold climes, where ambient (outdoor) temperature may be more than 20-30 degrees lower than room (indoor) temperature for up to six months of the year, furnace heating may remain predominant for the foreseeable future due to a lack of competitive alternatives. Therefore, there is currently a great impetus to increase thermal efficiency of buildings, even by small amounts.

Walls and windows, including window glass and structural assemblies for retaining the window glass, are important for overall thermal efficiency of buildings. Structural assemblies, e.g. including extrusions providing structural support, may generally have lesser outdoor surface area than walls and/or window glass. Nevertheless, structural assemblies may comprise aluminium, steel, and/or other materials that are thermally conductive and can therefore form thermal bridges across the window and act as heat sinks and sources.

In some aspects, it is found that increasing thermal efficiency of structural assemblies by preventing heat transfer along thermally conductive structural members extending between opposite sides of the window may considerably increase thermal efficiency of windows, and thereby improve overall building efficiency. e.g. indoor and outdoor sides. For example, in some cases, it is found that sufficiently increasing thermal efficiency of structural assemblies according to aspects disclosed herein may allow a double-glazed window to operate with a thermal efficiency nearing or exceeding a triple-glazed window coupled to prior art structural assemblies.

In some aspects, there is disclosed a structural member of a window having two spaced apart portions that are coupled together with a thermal break extending at least 40 mm therebetween. It is found that such a configuration is particularly effective for increasing the thermal efficiency of the window. For example, thermal efficiency may be increased when the window separates room temperature indoor spaces from outdoor spaces at temperatures below −10° C. The thermal break may be a non-metal structure made of materials such as a polyamides (e.g. Nylon 6, and Kevlar) and other structural plastics. The thermal break may be configured for structural support to unitize the structural member while keeping the two spaced apart portions, which may face opposite sides of the window, thermally de-bridged. Structural members may include transoms, jambs, mullions, sills, heads, sashes, and/or stiles.

In some aspects, there is disclosed a thermal break which frictionally engages with the two spaced apart portions. The thermal break may be formed by disposing an insulating structure in a space between the two spaced apart portions and frictionally engaging the insulating structure therewith. For example, application of heat and cutting of metal may not be required.

In some aspects, there is disclosed a thermal break which provides structural support without filling up a space between the two spaced apart portions. For example, costs and weight of the structural member may be reduced. Furthermore, insulating materials adapted to particular needs may be filled in between the two spaced apart portions, e.g. insulating materials for preventing condensation. Structural members may also be pressure equalized to prevent moisture penetration.

In some aspects, there is disclosed a stiffener for stiffening a structural member without introducing a thermal bridge. The stiffener comprises two spaced apart ends engaging with opposing ends of the structural member and which are coupled together using a thermal break. Using a stiffener may provide support under loading, including due to thermal expansion, wind loading, and/or seismic loading. For example, in some cases an additional 2 feet of vertical height may be structurally possible by use of a stiffener. Advantageously, additional height may be achieved without sacrificing insulation characteristics.

In some aspects, there is disclosed a (thermally broken) transom structurally anchored to a floor slab using a head that slidably engages with a face of the transom to allowing a range of vertical motion of the head relative to the transom. An anchoring structure, e.g. floor slab, may deflect due to increased weight therein, wind loading, thermal expansion, and/or seismic loading. Allowing compensatory vertical motion may reduce stresses on the window. In some cases, using a non-metal thermal break greater than 40 mm in forming structural members may increase flexibility and/or increase applied torque thereon. In some aspects, there is disclosed a (thermally broken) mullion including two frictionally engaged extrusions on each side of the thermal break. The frictionally engagement may allow a range of compensatory horizontal motion. In some aspects, there are disclosed extruded features that stiffen structural members and compensate for any reduction in structural strength due to the thermal break. The extruded features may hinder thermal bridging by not connecting two spaced apart portions of a structural member.

Further details of these and other aspects of the subject matter of this application will be apparent from the detailed description included below and the drawings.

DESCRIPTION OF THE DRAWINGS

Reference is now made to the accompanying drawings, in which.

DETAILED DESCRIPTION

The following disclosure relates to windows and structural members used to form windows. In some embodiments, the methods, devices, and assemblies disclosed herein can facilitate more thermally efficient windows compared to existing windows.

For example, results of thermal simulations for various configurations (cases) are shown in TABLE 1 for example embodiments of a 600 mm×1500 mm casement window. The thermal simulations were conducted in compliance with NFRC Thermal Simulation requirements as well as CSA-A440.2-14 Energy Performance of Windows and Other Fenestration Systems, using NFRC approved software (THERM 7.4 and WINDOW 7.4).

Windows show low U-values for all cases (lower are better).

TABLE 1

| Case | Description | U-value | SHGC | VT |
|---|---|---|---|---|
| 1 | Double glazed, 90% Argon filled | 0.477 | 0.240 | 0.399 |
| 2 | Triple glazed, low-E glass #1, 90% Argon filled | 0.422 | 2.395 | 0.221 |
| 3 | Laminated double glazed, air filled, 3 mm interlayer replacing 3 mm of glass | 0.473 | 0.240 | 0.398 |
| 4 | Triple glazed, low-E glass #2, 90% Argon filled | 0.387 | 0.191 | 0.304 |

*U-values are provided in BTU/h-ft$^2$-° F., SHGC is solar heat gain coefficient, VT is visible light transmittance, and CR is condensation resistance.

TABLE 2 shows granular results from a simulation wherein the outdoor temperature is fixed at −18° C. and indoor temperature is fixed at 21° C. Despite the large temperature difference, the frame surface and glass edge temperatures may only show between 24-38% of this temperature difference.

TABLE 2

| | Frame surface (° C.) | | | Glass edge (° C.) | | |
|---|---|---|---|---|---|---|
| Case | Head | Sill | Jamb | Head | Sill | Jambe |
| 1 | 7.3 | 6.9 | 7 | 8.2 | 6.1 | 6.9 |
| 2 | 6.9 | 6.5 | 6.5 | 11.6 | 10.3 | 10 |
| 3 | 7.1 | 6.9 | 7 | 9.6 | 6.2 | 8.2 |
| 4 | 6.8 | 6.7 | 6.6 | 11.7 | 11.8 | 11.8 |

Aspects of various embodiments are described in relation to the figures.

Figure 1B:
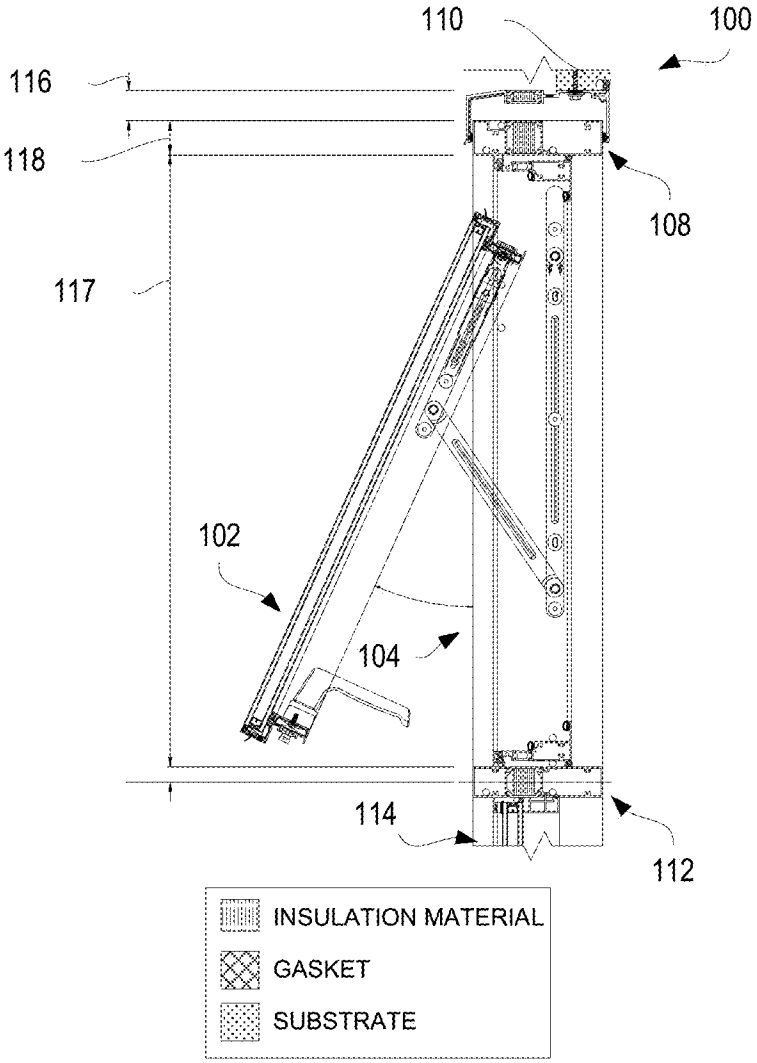
FIG. 1B is a cross-sectional view of the window along line 1B-1B in FIG. 1.
Figure 1A:
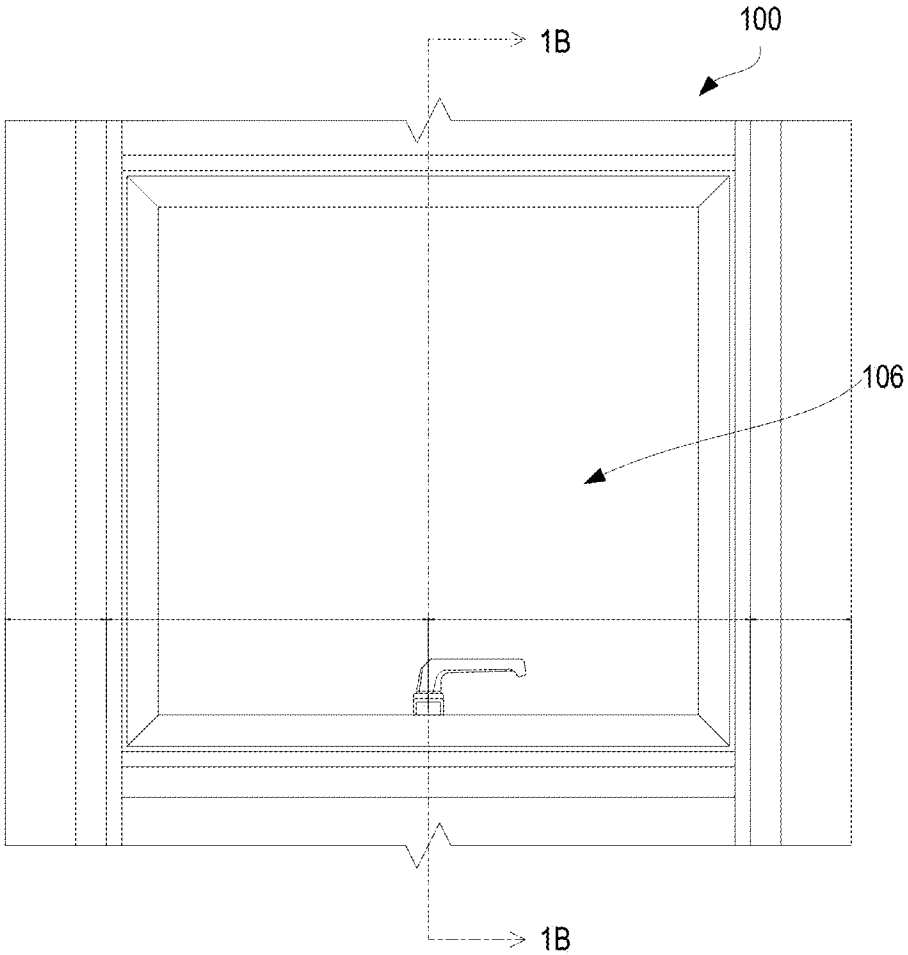
FIG. 1A is a front elevation view of a window, in accordance with an embodiment.

FIG. 1A is a front elevation view of a window 100, in accordance with an embodiment.

FIG. 1B is a cross-sectional view of the window 100 along the line 1B-1B in FIG. 1.

The window 100 may be a casement window configured to open towards an outdoor direction (swing open towards the exterior). The window 100 may include a vent 102 configured to fit into a frame 104. The vent 102 may comprise window glass 106. The frame 104 may comprise a plurality of structural members.

The window 100 may include a transom 108 anchored to a building substrate 110 (such as concrete) and a sill 112 coupled to an adjacent window 114.

In some embodiments, the transom 108 may include two portions. An upper portion having a sectional length 116 of 35 mm and a lower portion having a sectional length 118 of 40 mm. In some embodiments, the frame 104 may define an opening having a section length 117 of 708 mm.

Figure 2:
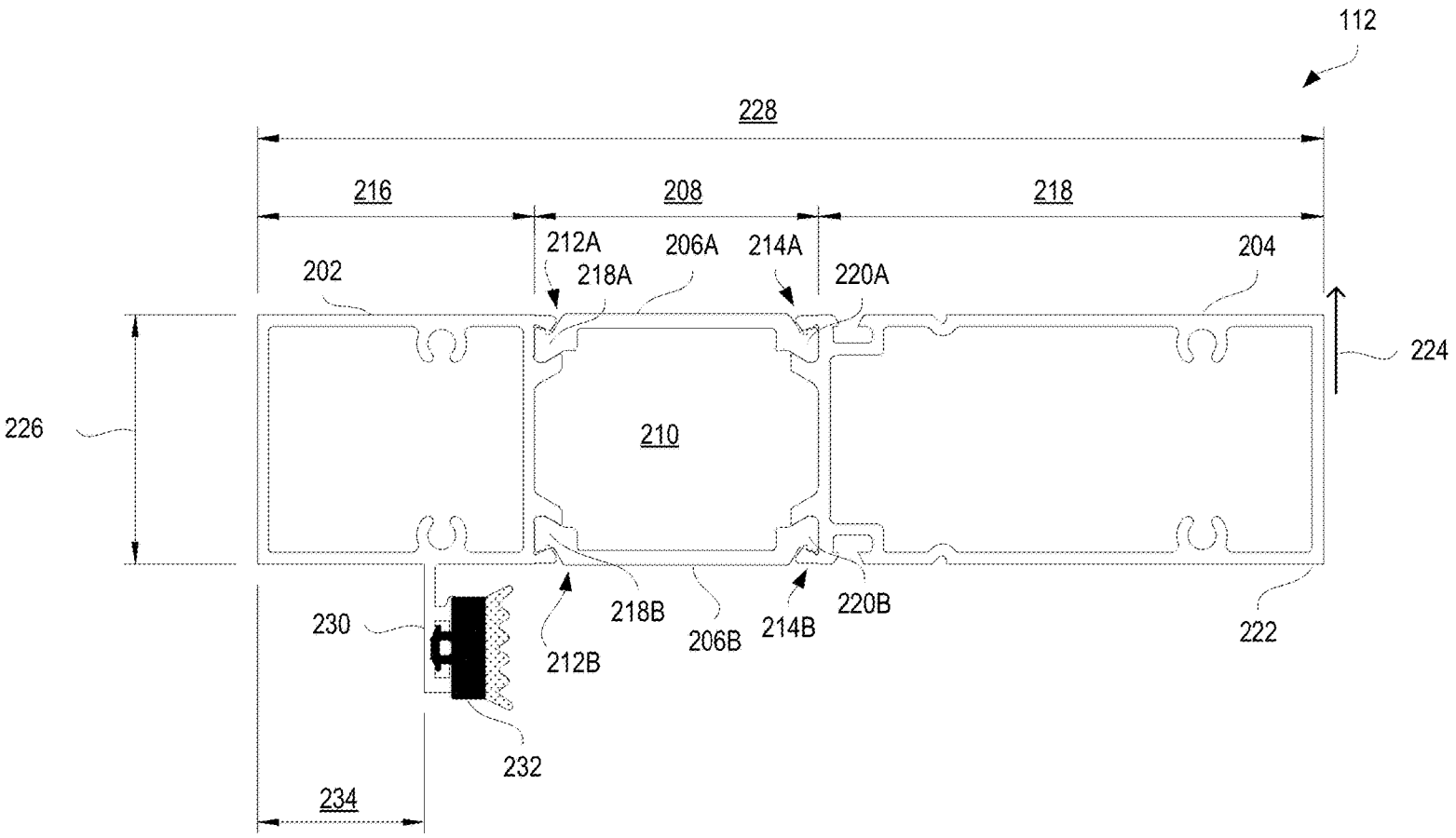
FIG. 2 is a cross-sectional view of a sill of the window.

FIG. 2 is a cross-sectional view of the sill 112 of the window 100.

The sill 112 may be a structural member of the window 100.

The sill 112 includes a first extrusion 202 and a second extrusion 204 spaced apart from the first extrusion 202. The first extrusion 202 and the second extrusion 204 define a distance of at least 40 mm between them.

An insulating coupler 206A extends at least 40 mm (see length 208) between the first extrusion 202 and the second extrusion 204 to couple the first extrusion 202 to the second extrusion 204 to form a structural member. The insulating coupler 206A may hinder thermal bridging of the first extrusion 202 and the second extrusion 204. An insulating coupler 206B similarly extends between the first extrusion 202 and the second extrusion 204.

The insulating coupler 206A may be rigid or structurally coupled to the first extrusion 202 and the second extrusion 204. In various embodiments, the first extrusion 202 may be coupled to the insulating coupler 206A via a dovetail joint 212A, and to the insulating coupler 206B via a dovetail joint 212B. In various embodiments, the second extrusion 204 may be coupled to the insulating coupler 206A via a dovetail joint 214A, and to the insulating coupler 206B via a dovetail joint 214B. In various embodiments, ends 218A, 218B of the insulating couplers 206A, 206B may be configured to couple with the first extrusion 202. The ends 218A, 218B may be elongated along the first extrusion 202 to form the dovetail joints 212A, 212B. Other ends 220A, 220B of the insulating couplers 206A, 206B may be configured to couple with the second extrusion 204. The other ends 220A, 220B may be elongated along the second extrusion 204 to form the dovetail joints 214A, 214B.

The insulating coupler 206A at least partially defines or forms a cavity 210 between the first extrusion 202 and the second extrusion 204 for receiving insulation material (see FIG. 1B). For example, the cavity 210 may be defined between the insulating couplers 206B, 206B.

In various embodiments, the first extrusion 202 extends at least 39 mm away from the insulating couplers 206A, 206B (see length 216). For example, extending 39 mm away from the insulating couplers 206A, 206B may change a heat distribution. The second extrusion 204 may extend at least 71 mm away from the insulating couplers 206A, 206B (see length 218).

The structural member may define an extrusion direction perpendicular to a longitudinal direction 222 and a lateral direction 224. In various embodiments, a lateral length of the structural member may be 35 mm (see length 226) and a longitudinal length of the structural member may be 150 mm.

In various embodiments, the first extrusion 202 and the second extrusion 204 may be metal extrusions, e.g. Aluminium extrusions (such as A6063-T5 alloy) or anodized aluminium extrusions. In various embodiments, the insulating coupler 206A comprises polyamide.

An arm 230 may extend outwardly from the first extrusion 202 for engaging window glass via a weather gasket 232. The arm 230 may be displaced 5.32" from a far end of the first extrusion 202 towards the insulating couplers 206A, 206B (see length 234). In various embodiments, the weather gasket 232 may comprise EPDM and EPDM foam sponge (at a tip thereof).

In some embodiments, extrusions may include more than one extrusion structurally coupled together.

Figure 3:
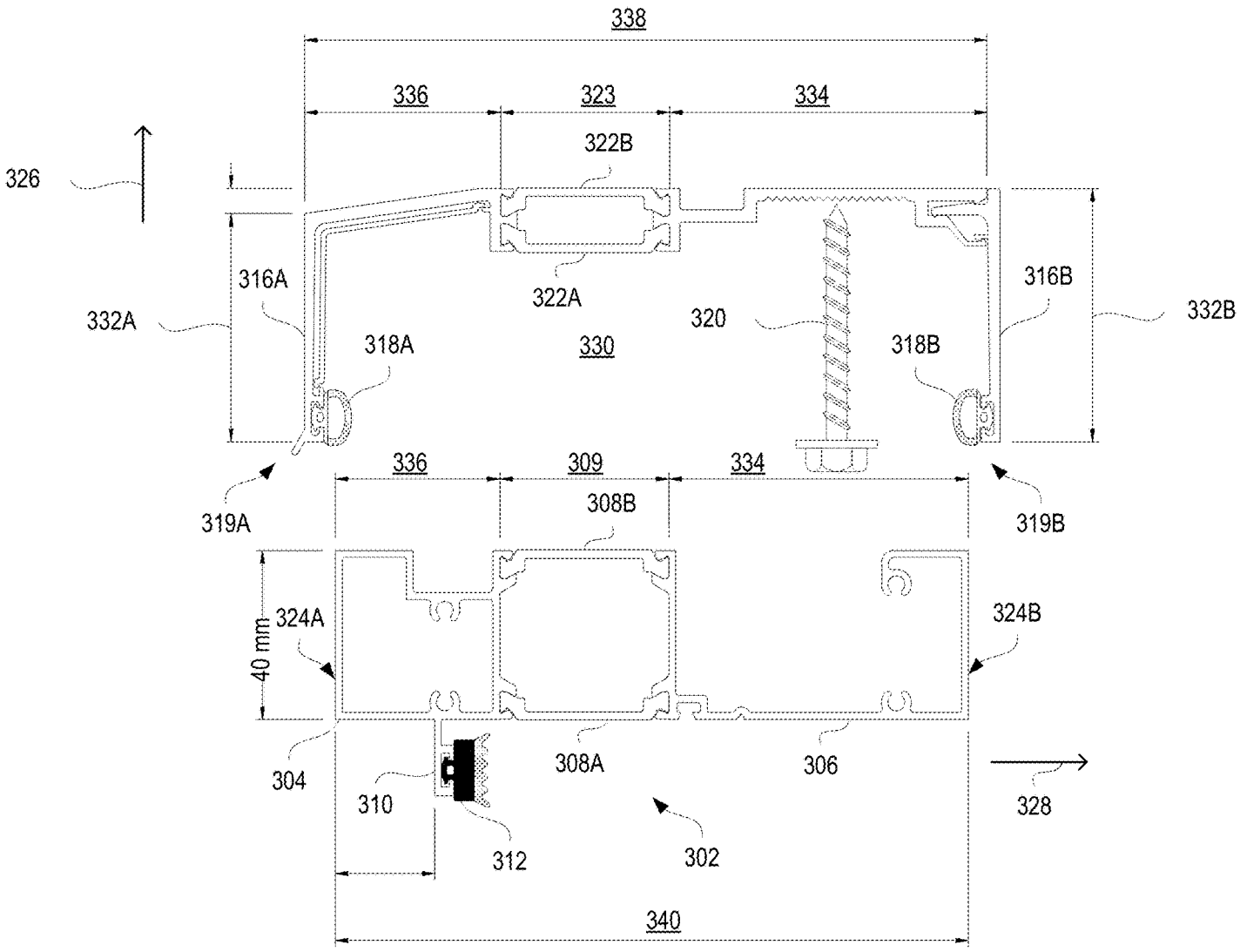
FIG. 3 is a cross-sectional view of a transom of the window.

FIG. 3 is a cross-sectional view of the transom 108 of the window 100.

A structural member 302 of the transom 108 may include a first extrusion 304 and a second extrusion 306 coupled together by insulating couplers 308A, 308B extending at least 40 mm therebetween (see length 309). The insulating couplers 308A, 308B may be configured to provide structural support and hinder thermal bridging.

An arm 310 may extend laterally from the first extrusion 304 to retain an adjacent window glass by pressing a weather gasket 312 against a surface of the window glass.

In various embodiments, the structural member 302 may extend longitudinally (or horizontally) substantially 150 mm (see length 340).

The transom 108 may include a head 314 configured to couple with the first extrusion 304. The head 314 may include arms 316A, 316B extending towards the first extrusion 304 and the second extrusion 306, respectively. In various embodiments, the head 314 may extend longitudinally (or horizontally) substantially 162 mm (see length 338).

The arms 316A, 316B may include gaskets 318A, 318B, respectively. The gaskets 318A, 318B may be opposed to each other, and may be deposed on opposing sides of the head 314. The arm 316A and the gasket 318A may together form a deformable member 319A. The arm 316B and the gasket 318B may together form a deformable member 319B. The deformable members 319A, 319B may define separate portions of the head 314 that are coupled together using insulating head couplers 322A, 322B. The insulating head couplers 322A, 322B may (each) extend at least 40 mm between the deformable member 319A and the deformable member 319B (see length 323) to hinder thermal bridging of the first extrusion and the second extrusion.

An outer face 324A of the first extrusion 304 may be opposed an outer face 324B of the second extrusion 306. In various embodiments the outer faces 324A, 324B may disposed at opposed far ends of the structural member 302.

The head 314 may be configured to slidably engage with an outer face 324A and the outer face 324B to hinder movement of the structural member 302B (including the first extrusion 304 and the second extrusion 306) relative to the head 314.

In various embodiments, the deformable members 319A, 319B may be configured to frictionally engage with the outer faces 324A, 324B, respectively, to retain the structural member 302 adjacent or partially within the head 314.

For example, the gaskets 318A, 318B may deform and apply pressure onto the outer faces 324A, 324B, respectively, to increase frictional force retaining the structural member 302. For example, the arms 316A, 316B may be resilient and may be deformed to accommodate the first extrusion 304 and the second extrusion 306, respectively. Such deformation may give rise to restoring forces in the arms 316A, 316B (material stresses), which may increase frictional force along the outer faces 324A, 324B to retain the structural member 302.

The insulating head couplers 322A, 322B may hinder thermal bridging of the first extrusion 304 and the second extrusion 306 while structurally connecting the two deformable members 319A, 319B.

A fastener 320 may be configured to fasten the head 314 to the building substrate 110 to prevent movement of the head 314. By coupling the structural member 302 to the head, the head 314 may anchor the transom 108 fastener 320 to hinder movement of the structural member 302, at least in some directions.

For example, in some embodiments, the building substrate 110 is a floor slab, and the head 314 is configured to hinder horizontal movement (see horizontal direction 328) of the structural member relative to the head and permit vertical movement (see vertical direction 326) relative to the head.

The two deformable members 319A, 319B. may defined a cavity 330 therebetween for at least partially housing the structural member 302.

In various embodiments, a length 332A of the arm 316A may be between 54 and 55 mm, a length 332B of the arm 316B may be 60 mm, In various embodiments, the deformable member 319A and the outer face 324A may be spaced 39 mm away from the insulating head couplers 322A, 322B and the insulating couplers 308A, 308B, respectively (see length 336). Similarly, in various embodiments, the deformable member 319B and the outer face 324B may be spaced between 71-76 mm away from the insulating head couplers 322A, 322B and the insulating couplers 308A, 308B, respectively (see length 334).

Figure 4:
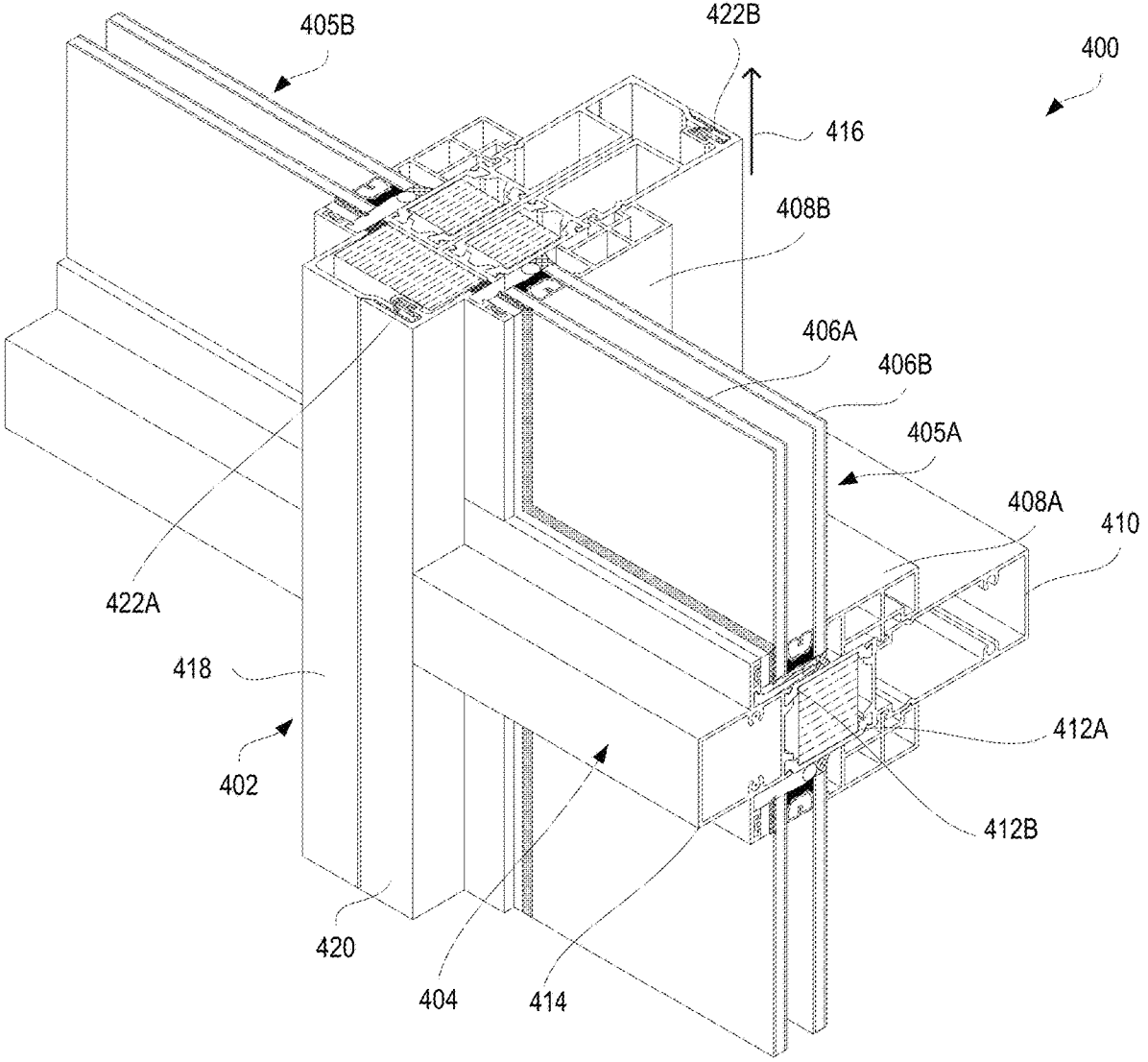
FIG. 4 is a perspective sectional view of a window showing a mullion intersecting a jamb, in accordance with an embodiment.

FIG. 4 is a perspective sectional view of a window 400 showing a mullion 402 intersecting a jamb 404, in accordance with an embodiment.

The window 400 may include window panes 405A, 405B that are double-glazed. The window pane 405A may comprise an outdoor window glass 406A and an indoor window glass 406B, structurally coupled to each other. The window pane 405 may be retained in the window 400 by stops 408A, 408B abutting the indoor window glass 406B. The stop 408A may be coupled or frictionally engaged with an extrusion 410 of the jamb 404. The extrusion 410 may be coupled to insulating couplers 412A, 412B, which may be coupled to an extrusion 414. The extrusion 414 may be thermally de-bridged from the extrusion 410.

The mullion 402 may extend along an extrusion direction 416 and may separate the window pane 405A from the window pane 405B. A male structural member 418 of the mullion 402 may couple with a female structural member 420 of the mullion 402 along the extrusion direction 416 to form an elongated joints 422A, 422B. The mullion 402 may be a two-part mullion.

Figure 5:
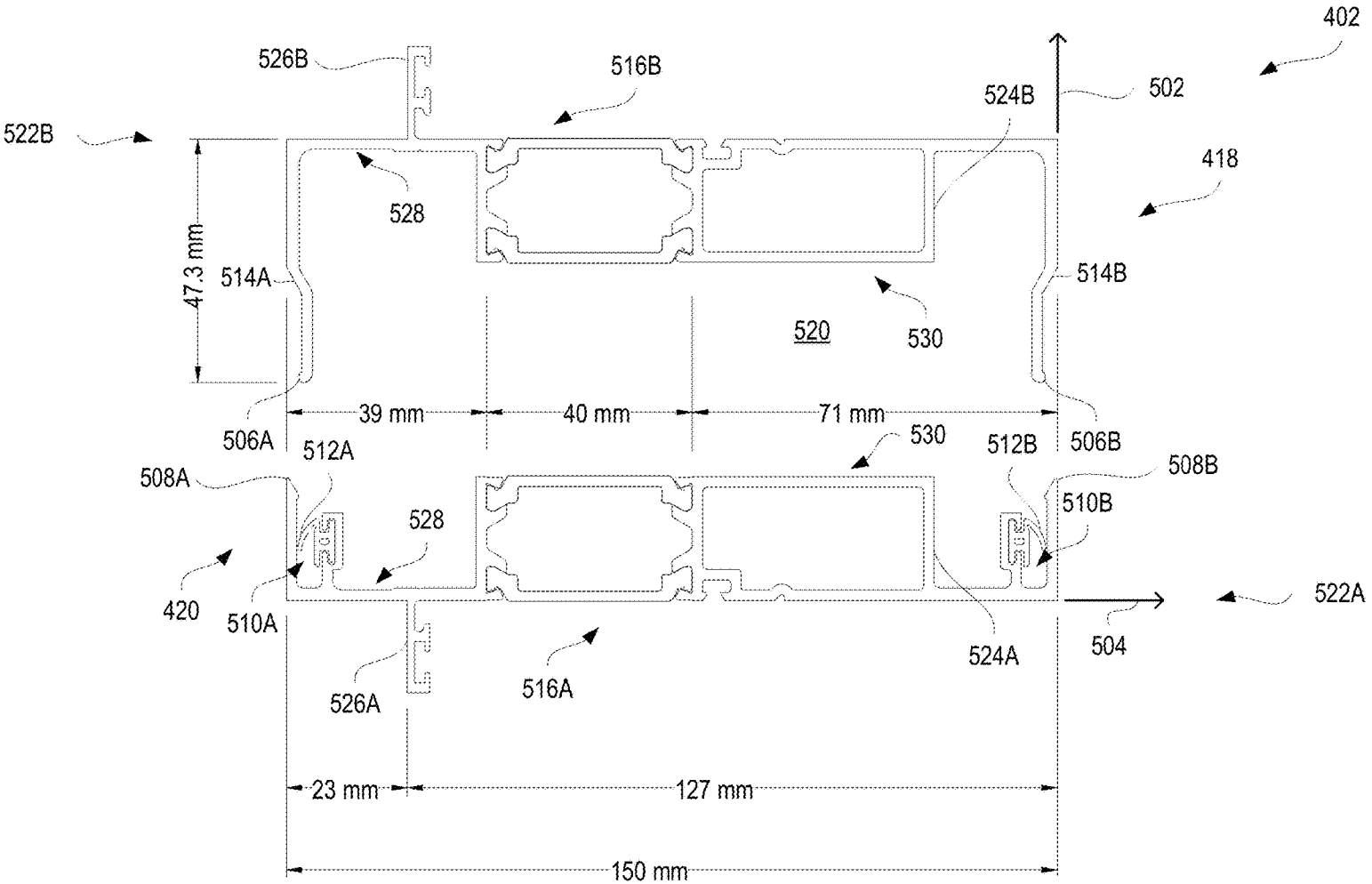
FIG. 5 is cross-sectional view of the mullion.

FIG. 5 is cross-sectional view of the mullion 402 of the window 400.

The mullion 402 is extended along the extrusion direction 416, extends between window panes 405A, 405B along a lateral direction 502, and separates indoor and outdoor spaces (or any other two spaces which the window 400 separates) along a longitudinal direction 504.

Proceeding along the lateral direction 502, the mullion 402 comprises the female structural member 420 and the male structural member 418.

In various embodiments, the male structural member 418 may comprise extruded portions 506A, 506B and the female structural member 420 may comprise extruded portion 508A, 508B. The extruded portions 508A, 508B may define slots 510A, 510B (or cavities), respectively. The slots 510A, 510B of the extruded portions 508A, 508B may be configured to receive extruded portions 506A, 506B, respectively, to frictionally engage therewith, along the elongated joints 422A, 422B extending in the extrusion direction 416.

In some embodiments, gaskets 512A, 512B may be disposed in the slots 510A, 510B, respectively, to provide sealing and increase frictional engagement. In some embodiments, the gaskets 512A, 512B may include arms configured for one-way movement in the slots 510A, 510B, respectively (e.g. snap-on features). In some embodiments, the extruded portions 506A, 506B may define grooves 514A, 514B (or incline steps), respectively. The grooves 514A, 514B may be configured to accommodate the extruded portions 508A, 508B, respectively.

Proceeding along the longitudinal direction 504 the mullion 402 may comprise a first extrusion 528 and a second extrusion 530 coupled together by insulating coupler assemblies 516A, 516B.

A part of the male structural member 418 may form part of the first extrusion 528, and another part of the male structural member 418 may form part of the second extrusion 530. Similarly, a part of the female structural member 420 may form part of the first extrusion 528, and another part of the female structural member 420 may form part of the second extrusion 530.

The insulating coupler assemblies 516A, 516B may each include laterally spaced apart insulating couplers, each of which may extend at least 40 mm between the first extrusion 428 and the second extrusion 530. In various embodiments, the insulating couplers may, e.g. structurally or rigidly, couple the first extrusion 528 to the second extrusion 530 to form one or more cavities between the first extrusion 528 and the second extrusion 530 for receiving insulation materials.

In various embodiments, the insulating coupler assemblies 516A, 516B may define a space or cavity 520 therebetween. The cavity 520 may be define between two opposed lateral ends 522A, 522B of the mullion 402. In various embodiments, the insulating coupler assembly 516A may define the first lateral end 522A between the first extrusion 528 and the second extrusion 530, and the insulating coupler assembly 516B may define the first lateral end 522B between the first extrusion 528 and the second extrusion 530.

In various embodiments, the mullion 402 may including stiffening extrusions 524A, 524B that are disposed completely on one side of the mullion to prevent thermal interaction or bridging that may reduce efficiency. In various embodiments, the stiffening extrusions 524A, 524B may be in unitary construction with the second extrusion 530 and spaced apart from the first extrusion 528 to stiffen the mullion 402 without thermally bridging the first extrusion and the second extrusion.

In various embodiments, the stiffening extrusions 524A, 524B are disposed inside the second extrusion 530 and are frictionally engaged with insulating couplers of the insulating coupler assemblies 516A, 516B.

In various embodiments, the stiffening extrusions 524A, 524B extend between non-parallel faces of the second extrusion 530. For example, the two non-parallel faces may be perpendicular to each other, as shown in FIG. 5.

In various embodiments, the first extrusion 528 may include arms 526A, 526B extending outwardly therefrom for engaging with window panes (via gaskets, not shown in FIG. 5). The arms 526A, 526B may be in unitary construction with the first extrusion 528.

Figure 6:
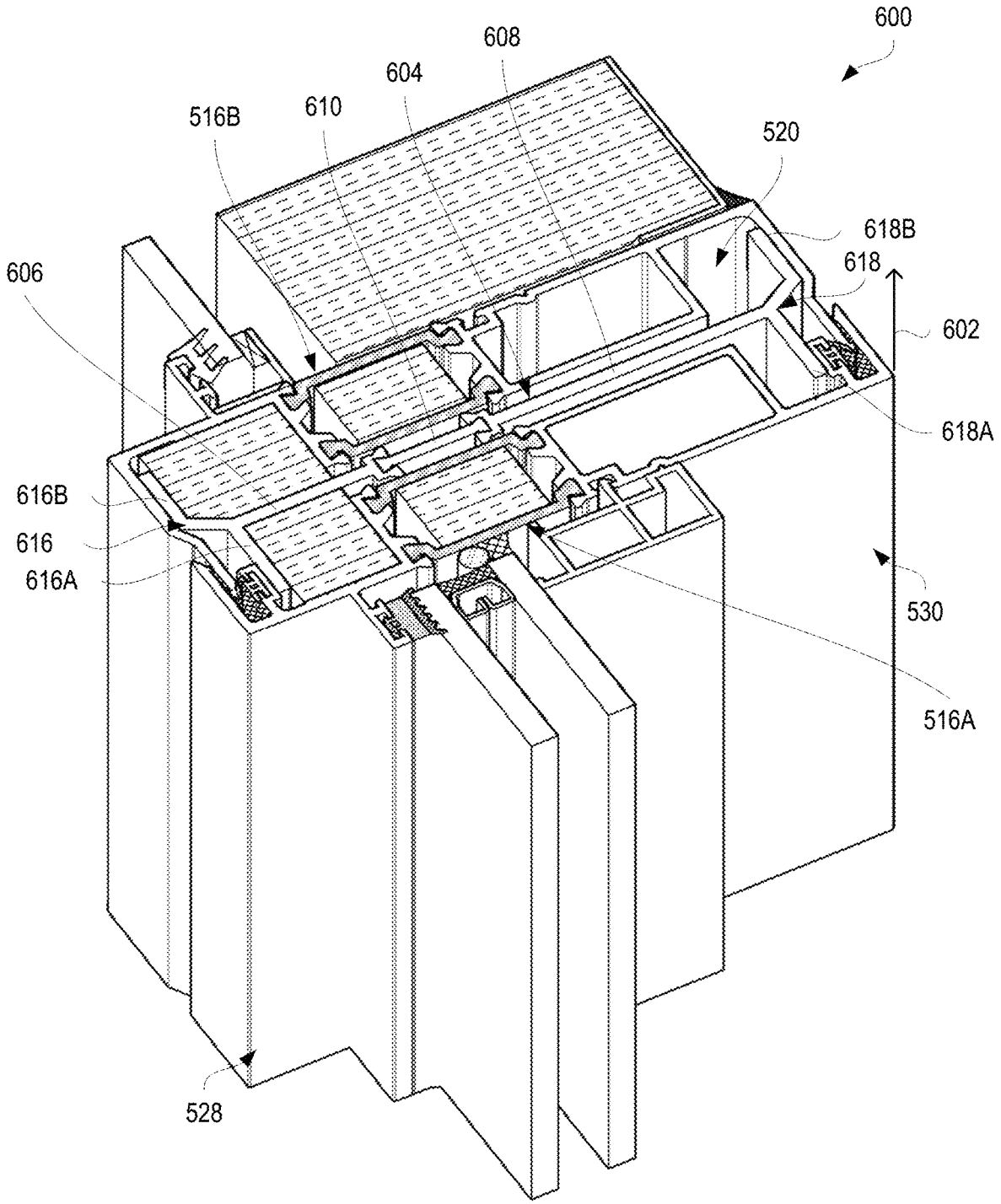
FIG. 6 is a perspective sectional view of a mullion, in accordance with another embodiment.

FIG. 6 is a perspective sectional view of a mullion 600, in accordance with another embodiment.

The mullion extends along an extrusion direction 602. For clarity and brevity, discussions of aspects of the mullion 600 in common with the mullion 402 shown in FIGS. 4-5 are not repeated. Such aspects, and associated reference numerals, may be obtained or inferred from those in FIGS. 4-5.

The mullion 600 may include stiffener 604 extending between the first extrusion 528 and the second extrusion 530 to stiffen the mullion 600.

The stiffener 604 may include a first stiffener end 606 engaged with an end of the first extrusion 528 and spaced apart from the second extrusion 530, and a second stiffener end 608 engaged with an end of the second extrusion 530 and spaced apart from the first extrusion 528. The end of the first extrusion 528 the end of the second extrusion 530 may be thermally separated from each other.

The first stiffener end 606 and the second stiffener end may be disposed inside the first extrusion 528 and the second extrusion 530, respectively.

The stiffener 604 may include an insulating stiffener coupler 610 configured to (e.g. rigidly or structurally) couple the first stiffener end 606 to the second stiffener end 608 for stiffening the mullion 600. In various embodiments, insulating stiffener coupler 610 may be disposed between the first stiffener end 606 and the second stiffener end 608.

The stiffener 604 may be configured to hinder thermal bridging of the first stiffener end 606 and the second stiffener end 608 by forming a thermal break using the insulating stiffener coupler 610 while maintaining structural integrity and stiffening properties.

In some embodiments, the stiffener 604 is disposed adjacent to the insulating couplers of the one or more of the insulating coupler assemblies 516A, 516B to hinder (e.g. lateral) deflection of the insulating stiffener coupler 610. In various embodiments, the insulating stiffener coupler 610 may be confined between the insulating coupler assemblies 516A to hinder deflection of the stiffener 604. For example, buckling or undesirable deflection may be reduced. In some embodiments, the stiffener 604 may at least partially be disposed in the cavity 520.

In some embodiments, the first stiffener end 606 is an extrusion having a T-shaped section 616. In some embodiments, an arm 616A of the T-shaped section 616 may be configured to frictionally engage with the extruded portion 508A of the first extrusion 528, and a second arm 616B of the T-shaped section 616 may be configured to frictionally engage with the extruded portion 506A of the first extrusion 528.

In some embodiments, the second stiffener end 608 is an extrusion having a T-shaped section 618. In some embodiments, an arm 618A of the T-shaped section 618 may be configured to frictionally engage with the extruded portion 508B of the second extrusion 530, and a second arm 618B of the T-shaped section 618 may be configured to frictionally engage with the extruded portion 506B of the second extrusion 530.

In various embodiments, the first stiffener end 606 and the second stiffener end 608 may comprise or be made of the same material, e.g. Aluminium, as the first extrusion 528 and the second extrusion 530, respectively. This may prevent galvanic action and preserve longevity.

Figure 7:
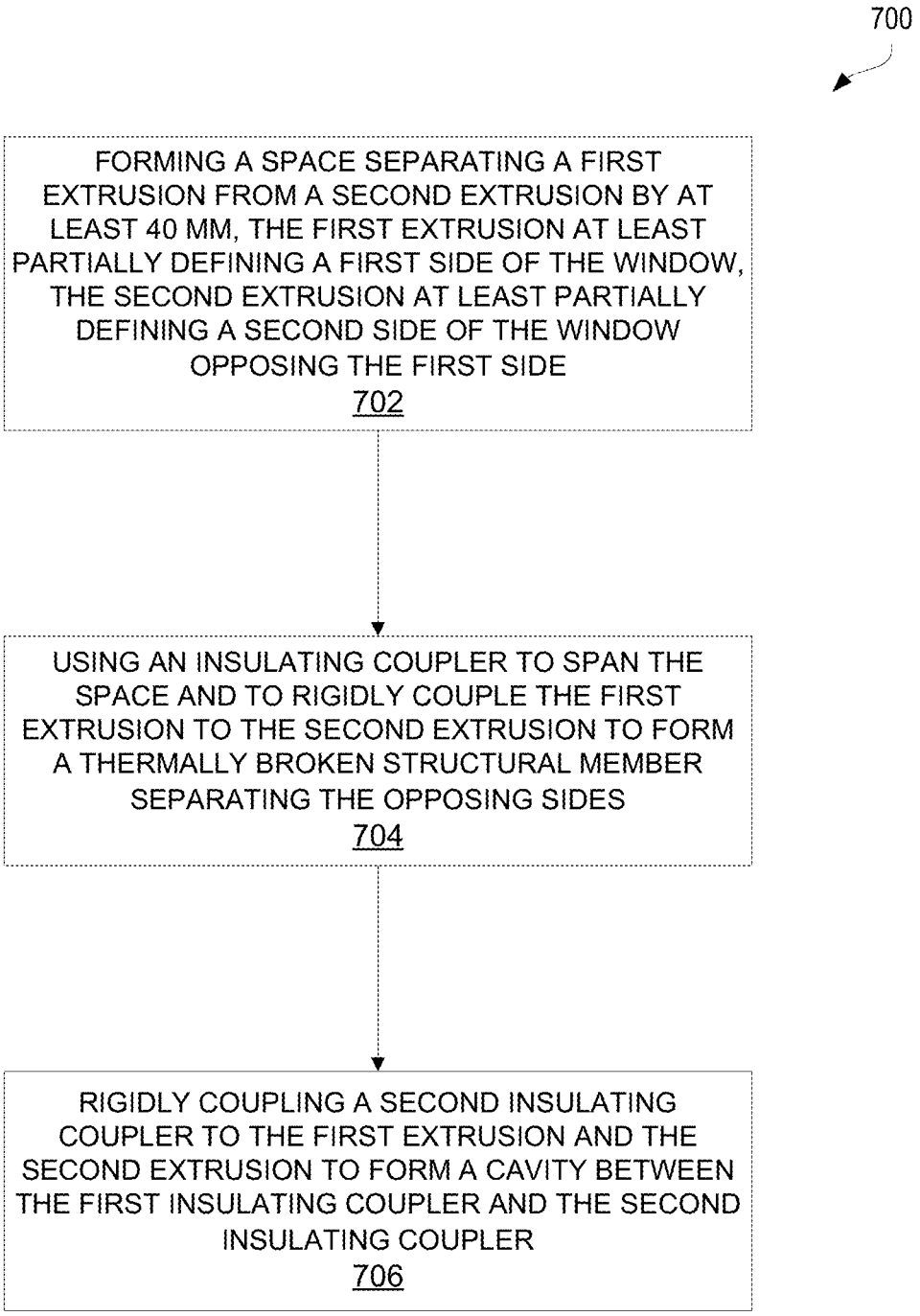
FIG. 7 is a flow chart of a method of forming a thermally broken structural member for a window, in accordance with an embodiment.

FIG. 7 is a flow chart of a method 700 of forming a thermally broken structural member for a window, in accordance with an embodiment.

Step 702 includes forming a space separating a first extrusion from a second extrusion by at least 40 mm, the first extrusion at least partially defining a first side of the window, the second extrusion at least partially defining a second side of the window opposing the first side; and Step 703 includes, after forming the space, using an insulating coupler to span the space and to rigidly couple the first extrusion to the second extrusion to form a thermally broken structural member separating the opposing sides.

Step 704 includes, after forming the space and using the insulating coupler to rigidly couple the first extrusion to the second extrusion, rigidly coupling a second insulating coupler to the first extrusion and the second extrusion to form a cavity between the first insulating coupler and the second insulating coupler.

Some embodiments of the method 700 include frictionally engaging the first extrusion with a first stiffener structure; frictionally engaging the second extrusion with a second stiffener structure; and coupling the first stiffener structure and the second stiffener structure using an insulating stiffener coupler to provide structural support and to hinder thermal bridging between the first stiffener structure and the second stiffener.

As can be understood, the examples described above and illustrated are intended to be exemplary only.

The embodiments described in this document provide non-limiting examples of possible implementations of the present technology. Upon review of the present disclosure, a person of ordinary skill in the art will recognize that changes may be made to the embodiments described herein without departing from the scope of the present technology. For example, steel may be used instead of aluminium. Yet further modifications could be implemented by a person of ordinary skill in the art in view of the present disclosure, which modifications would be within the scope of the present technology.

What is claimed is:

1. A structural member for a window, comprising:

a first extrusion;

a second extrusion spaced apart from the first extrusion;

an insulating coupler extending between the first extrusion and the second extrusion to couple the first extrusion to the second extrusion to form the structural member and hinder thermal bridging of the first extrusion and the second extrusion; and a stiffener extending between the first extrusion and the second extrusion to stiffen the structural member, the stiffener including a first stiffener end engaged with the first extrusion and spaced apart from the second extrusion, a second stiffener end engaged with the second extrusion and spaced apart from the first extrusion, and an insulating stiffener coupler configured to couple the first stiffener end to the second stiffener end for stiffening the structural member and hinder thermal bridging of the first stiffener end and the second stiffener end.

2. The structural member of claim 1, wherein the stiffener is disposed adjacent to the insulating coupler to hinder deflection of the insulating stiffener coupler.

3. The structural member of claim 1, wherein the first extrusion is coupled to the insulating coupler via a first dovetail joint, and the second extrusion is coupled to the insulating coupler via a second dovetail joint.

4. A structural member for a window, the structural member being a mullion, the structural member comprising:

a first extrusion;

a second extrusion spaced apart from the first extrusion;

a first insulating coupler assembly defining a first lateral end of the structural member between the first extrusion and the second extrusion, the first insulating coupler assembly including a first insulating coupler extending between the first extrusion and the second extrusion to couple the first extrusion to the second extrusion to form the structural member and hinder thermal bridging of the first extrusion and the second extrusion, and a second insulating coupler separate from the first insulating coupler and extending between the first extrusion and the second extrusion to couple the first extrusion to the second extrusion to form a cavity between the first extrusion and the second extrusion for receiving insulation material, each of the first and second extrusions extending between the first and the second insulating couplers to separate the first and second insulating couplers and to structurally couple the first and second insulating couplers to each other, the cavity extending from the first extrusion to the second extrusion and defined between the first insulating coupler and the second insulating coupler; and a second insulating coupler assembly defining a second lateral end of the structural member between the first extrusion and the second extrusion, the second lateral end opposite the first lateral end.

5. The structural member of claim 4, further comprising:

a stiffener extending between the first extrusion and the second extrusion to stiffen the structural member, the stiffener including a first stiffener structure engaged with the first extrusion and spaced apart from the second extrusion, a second stiffener structure engaged with the second extrusion and spaced apart from the first extrusion, and an insulating stiffener coupler configured to couple the first stiffener structure to the second stiffener structure for stiffening the structural member and to hinder thermal bridging of the first stiffener structure and the second stiffener structure, the insulating stiffener coupler confined between the first insulating coupler assembly and the second insulating coupler assembly to hinder deflection of the stiffener.

6. The structural member of claim 1, further comprising:

a stiffening extrusion in unitary construction with the second extrusion and spaced apart from the first extrusion to stiffen the structural member without thermally bridging the first extrusion and the second extrusion.

7. The structural member of claim 6, wherein the stiffening extrusion is disposed inside the second extrusion and is frictionally engaged with the insulating coupler.

8. The structural member of claim 1, wherein the first extrusion and second extrusion are metal extrusions, and the insulating coupler includes polyamide.

9. The structural member of claim 1, wherein the structural member is a mullion, and the first extrusion includes a first extruded portion and a second extruded portion, the first extruded portion frictionally engaged with the second extruded portion along an elongated joint extending in an extrusion direction.

10. A structural member for a window, the structural member being of a transom, comprising:

a first extrusion;

a second extrusion spaced apart from the first extrusion;

an insulating coupler extending between the first extrusion and the second extrusion to couple the first extrusion to the second extrusion to form the structural member and hinder thermal bridging of the first extrusion and the second extrusion;

a head configured to slidably engage with an outer face of the first extrusion and an outer face of the second extrusion to hinder movement of the first extrusion and the second extrusion relative to the head; and a fastener to fasten the head to a building substrate to anchor the structural member, wherein the building substrate is a floor slab, and the head is configured to hinder horizontal movement of the first extrusion and second extrusion relative to the head and permit vertical movement relative to the head.

11. A structural member for a window, the structural member being of a transom, comprising:

a first extrusion;

a second extrusion spaced apart from the first extrusion;

an insulating coupler extending between the first extrusion and the second extrusion to couple the first extrusion to the second extrusion to form the structural member and hinder thermal bridging of the first extrusion and the second extrusion;

a head configured to slidably engage with an outer face of the first extrusion and an outer face of the second extrusion to hinder movement of the first extrusion and the second extrusion relative to the head; and a fastener to fasten the head to a building substrate to anchor the structural member, wherein the head includes a first deformable member for frictionally engaging with the outer face of the first extrusion, and a second deformable member for frictionally engaging with the outer face of the second extrusion, and an insulating head coupler extending between the first deformable member and the second deformable member to hinder thermal bridging of the first extrusion and the second extrusion.

12. A method of forming a thermally broken structural member for a window, comprising:

forming a space separating a first extrusion from a second extrusion by at least 40 mm, the first extrusion at least partially defining a first side of the window, the second extrusion at least partially defining a second side of the window opposing the first side;

after forming the space, using an insulating coupler to span the space and to rigidly couple the first extrusion to the second extrusion to form a thermally broken structural member separating the opposing sides, and rigidly coupling a second insulating coupler to the first extrusion and the second extrusion to form a cavity between the first insulating coupler and the second insulating coupler;

engaging frictionally with the first extrusion with a first stiffener structure;

engaging frictionally with the second extrusion with a second stiffener structure; and coupling the first stiffener structure and the second stiffener structure using an insulating stiffener coupler to provide structural support and to hinder thermal bridging between the first stiffener structure and the second stiffener structure.

13. A structural member for a window, comprising:

a first extrusion;

a second extrusion spaced apart from the first extrusion;

an insulating coupler extending at least 40 mm between the first extrusion and the second extrusion to couple the first extrusion to the second extrusion to form the structural member and hinder thermal bridging of the first extrusion and the second extrusion; and a stiffener extending between the first extrusion and the second extrusion to stiffen the structural member, the stiffener including a first stiffener end engaged with the first extrusion and spaced apart from the second extrusion, a second stiffener end engaged with the second extrusion and spaced apart from the first extrusion, and an insulating stiffener coupler configured to couple the first stiffener end to the second stiffener end for stiffening the structural member and hinder thermal bridging of the first stiffener end and the second stiffener end.

14. The structural member of claim 13, wherein the first extrusion is coupled to the insulating coupler via a first dovetail joint, the second extrusion is coupled to the insulating coupler via a second dovetail joint, and the first extrusion extends at least 39 mm away from the insulating coupler.

15. The structural member of claim 13, wherein the insulating coupler is a first insulating coupler of an insulating coupler assembly, and the structural member further comprises:

a second insulating coupler of the insulating coupler assembly, extending at least 40 mm between the first extrusion and the second extrusion to couple the first extrusion to the second extrusion to form a cavity between the first extrusion and the second extrusion for receiving insulation material, the cavity defined between the first insulating coupler and the second insulating coupler.

16. The structural member of claim 13, wherein the structural member is a structural member of a transom, the structural member further comprising:

a head configured to slidably engage with an outer face of the first extrusion and an outer face of the second extrusion to hinder movement of the first extrusion and the second extrusion relative to the head, the head including a first deformable member for frictionally engaging with the outer face of the first extrusion, and a second deformable member for frictionally engaging with the outer face of the second extrusion;

a fastener to fasten the head to a building substrate to anchor the structural member; and an insulating head coupler extending at least 40 mm between the first deformable member and the second deformable member to hinder thermal bridging of the first extrusion and the second extrusion wherein the building substrate is a floor slab, the head is configured to hinder horizontal movement of the first extrusion and second extrusion relative to the head and permit vertical movement relative to the head.

* * * * *